US008550057B2

(12) United States Patent
Prior

(10) Patent No.: US 8,550,057 B2
(45) Date of Patent: Oct. 8, 2013

(54) INTEGRAL ROTOR NOISE ATTENUATORS

(75) Inventor: Gregory P. Prior, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 391 days.

(21) Appl. No.: 12/429,682

(22) Filed: Apr. 24, 2009

(65) Prior Publication Data

US 2010/0269798 A1 Oct. 28, 2010

(51) Int. Cl.
*F02B 33/00* (2006.01)
*F02B 39/04* (2006.01)

(52) U.S. Cl.
CPC ..... *F02B 39/04* (2013.01)
USPC ..... 123/559.1; 181/214; 181/249; 181/250; 181/272; 418/151; 418/181; 418/191; 418/206.1; 418/206.5

(58) Field of Classification Search
CPC ..... F02B 39/04
USPC ..... 123/559.1; 418/181, 191, 206.5, 151, 418/206.1; 181/214, 249, 250, 272
See application file for complete search history.

(56) References Cited

U.S. PATENT DOCUMENTS

| | | | | |
|---|---|---|---|---|
| 3,278,225 | A * | 10/1966 | Stine | 297/148 |
| 3,401,676 | A * | 9/1968 | Wanzenberg | 123/215 |
| 3,993,159 | A * | 11/1976 | Amador | 181/230 |
| 4,971,536 | A * | 11/1990 | Takeda et al. | 418/206.5 |
| 5,084,641 | A * | 1/1992 | Saima et al. | 310/51 |
| 5,180,299 | A * | 1/1993 | Feuling | 418/190 |
| 5,350,887 | A * | 9/1994 | Sandstrom | 181/142 |
| 5,377,407 | A * | 1/1995 | Takahashi et al. | 29/889 |
| 5,638,600 | A * | 6/1997 | Rao et al. | 29/888.02 |
| 5,772,418 | A * | 6/1998 | Tateno et al. | 418/206.5 |
| 5,797,735 | A * | 8/1998 | Ishikawa et al. | 418/151 |
| 6,142,759 | A * | 11/2000 | Tateno et al. | 418/206.5 |
| 6,752,240 | B1 * | 6/2004 | Schlagenhaft | 181/249 |
| 6,874,486 | B2 | 4/2005 | Prior et al. | |
| 2005/0150718 | A1 * | 7/2005 | Knight et al. | 181/250 |
| 2007/0256889 | A1 * | 11/2007 | Yu et al. | 181/214 |
| 2008/0060622 | A1 | 3/2008 | Prior | |
| 2008/0168961 | A1 | 7/2008 | Prior et al. | |
| 2008/0170958 | A1 | 7/2008 | Prior et al. | |
| 2010/0269798 | A1 * | 10/2010 | Prior | 123/559.1 |

FOREIGN PATENT DOCUMENTS

| | | | |
|---|---|---|---|
| DE | 10123916 | A1 | 11/2002 |
| JP | 07217563 | A * | 8/1995 |

OTHER PUBLICATIONS

Boll et al (DE 101 23 916), English machine translation, 2002.*
Maruta et al (JP 07-217563), English machine translation, 1995.*
German Office Action Dated Dec. 18, 2012 for German Application No. 10 2010 015 756.2; 8 pages.

* cited by examiner

*Primary Examiner* — John K Kim
(74) *Attorney, Agent, or Firm* — Cantor Colburn LLP

(57) ABSTRACT

A supercharger is provided, comprising a plurality of rotatable supercharger rotors each having a plurality of interleavable lobes configured to move air from an inlet to an outlet of the supercharger. Inner chambers in the lobes define an end opening and perforated end faces, at the end openings defining at least one port, having a length and a diameter. The at least one port is configured to operate with an associated air mass in the inner chamber to attenuate sound adjacent to the end opening.

15 Claims, 6 Drawing Sheets

INTEGRAL ROTOR NOISE ATTENUATORS

FIELD OF THE INVENTION

Exemplary embodiments of the present invention are related to automotive engine Roots or screw-type superchargers and more specifically, to noise attenuation thereof.

BACKGROUND

Positive displacement superchargers of the Roots or screw type may be used in automotive engine applications to increase the cylinder air charge and, thus, provide for increased engine output. The rotors of a supercharger may be formed with helical lobes that provide for axial airflow from an inlet to an outlet of a supercharger housing. The inlet and the outlet of the supercharger housing may be configured to improve efficiency and reduce noise generated by the supercharger.

Engine intake air enters the supercharger at near-atmospheric pressure. The engine intake air directly upstream or downstream of the supercharger may be subject to pressure pulsations inherent to the operation of the supercharger. As a result, sound attenuation devices such as Helmholtz resonators and quarter wave chambers are often installed in the air intake system of the engine, upstream or downstream of the supercharger, in order to reduce resultant noise generated by the pressure pulsations. The addition of the aforementioned sound attenuation devices has proven to be sub-optimal in that they can be costly, they require space that is often at a premium in automotive under-hood applications, and they may not necessarily be locatable as close to the source of noise as is desired for effective noise reduction.

Accordingly, it is desirable to provide a noise attenuation device for a supercharger that is cost effective and may be located in close proximity to the location of noise producing pressure pulsations.

SUMMARY OF THE INVENTION

In one exemplary embodiment of the present invention, a supercharger is provided having first and second rotatable supercharger rotors disposed therein. Each supercharger rotor has a plurality of lobes configured to move air from an inlet to an outlet of the supercharger. An inner chamber is defined in each lobe and is configured to terminate at a lobe end opening. A perforated end face partially closes each lobe end opening and includes at least one port extending therethrough. The at least one port supports an oscillating air mass. A damping air mass in each inner chamber, adjacent to and in fluid communication with the oscillating air mass, attenuates the oscillating air mass and sound frequency associated therewith, adjacent to each lobe end opening.

In another exemplary embodiment of the present invention, a supercharger is provided having an axially extending housing with an upstream end wall, a downstream end wall and a surrounding wall extending therebetween to define an internal cavity within the axially extending housing. An inlet opening is configured to fluidly communicate the internal cavity with a source of inlet air. An outlet opening is configured to fluidly communicate the internal cavity with a compressed air chamber. A plurality of supercharger rotors each having a plurality of interleavable lobes are disposed for rotation within the internal cavity of the axially extending housing and are configured to move air from the inlet opening to the outlet opening. An inner chamber is defined in each of the interleavable lobes; the inner chambers terminating at lobe end openings. A perforated end face partially closes each lobe end opening; the perforated end faces having at least one port extending therethrough. Each port has a length and a diameter and supports an oscillating air mass. A damping air mass in each inner chamber, adjacent to and in fluid communication with the oscillating air mass, is operable with the at least one port to attenuate sound adjacent to the lobe end openings.

In yet another exemplary embodiment of the present invention, a method of sound attenuation of a supercharger having a plurality of rotatable supercharger rotors each having a plurality of interleavable lobes comprises forming an inner chamber in each interleavable lobe. Terminating each inner chamber at a lobe end opening of an interleavable lobe. Partially closing each lobe end opening with a perforated end face. Perforating each of the end faces with at least one port having a length and a diameter wherein the at least one port of each end face is configured to operate with an associated air mass in an inner chamber to attenuate sound adjacent to the lobe end opening.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
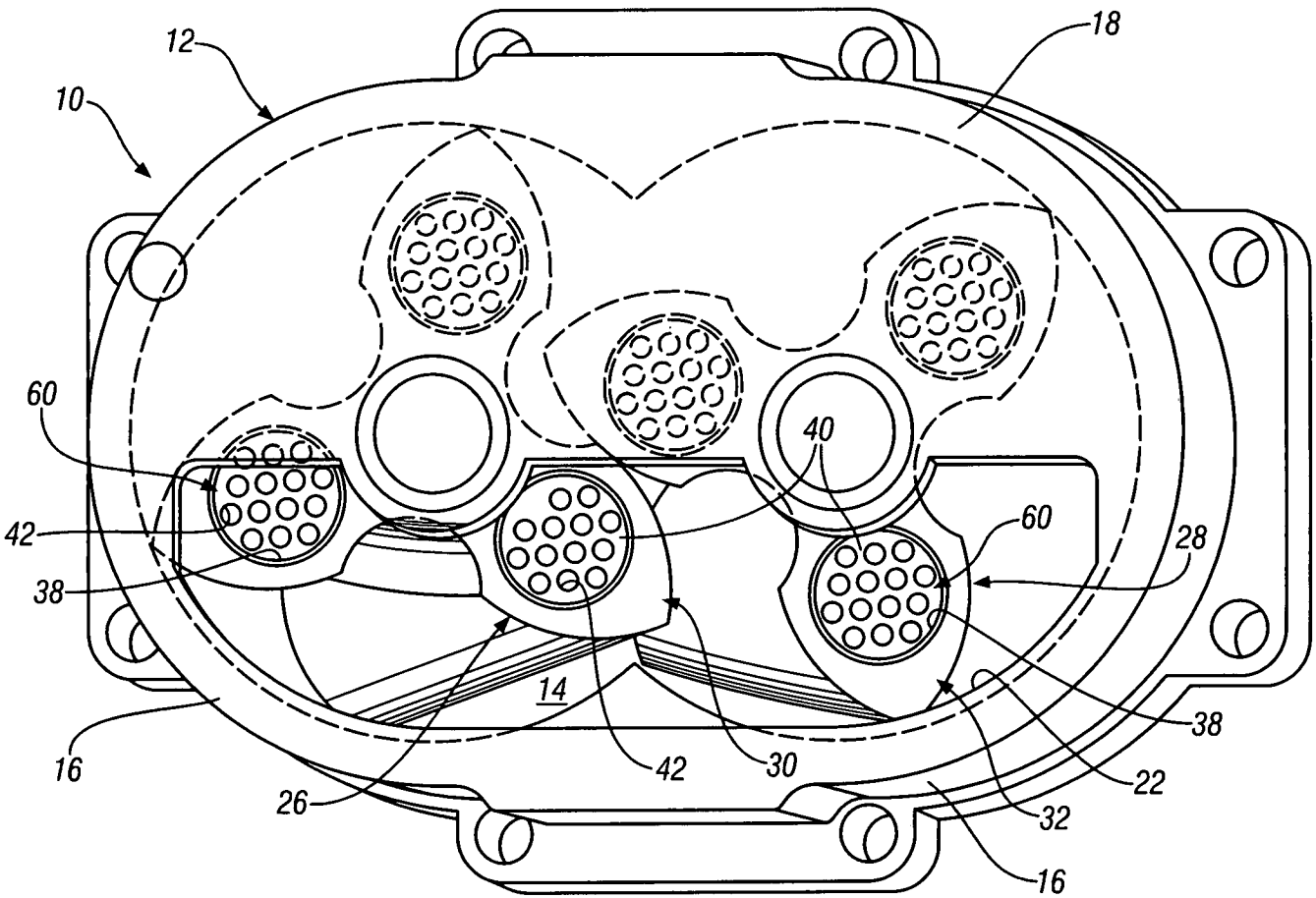
FIG. 1 is an inlet view of a Roots-type supercharger embodying features of the present invention.
Figure 2:
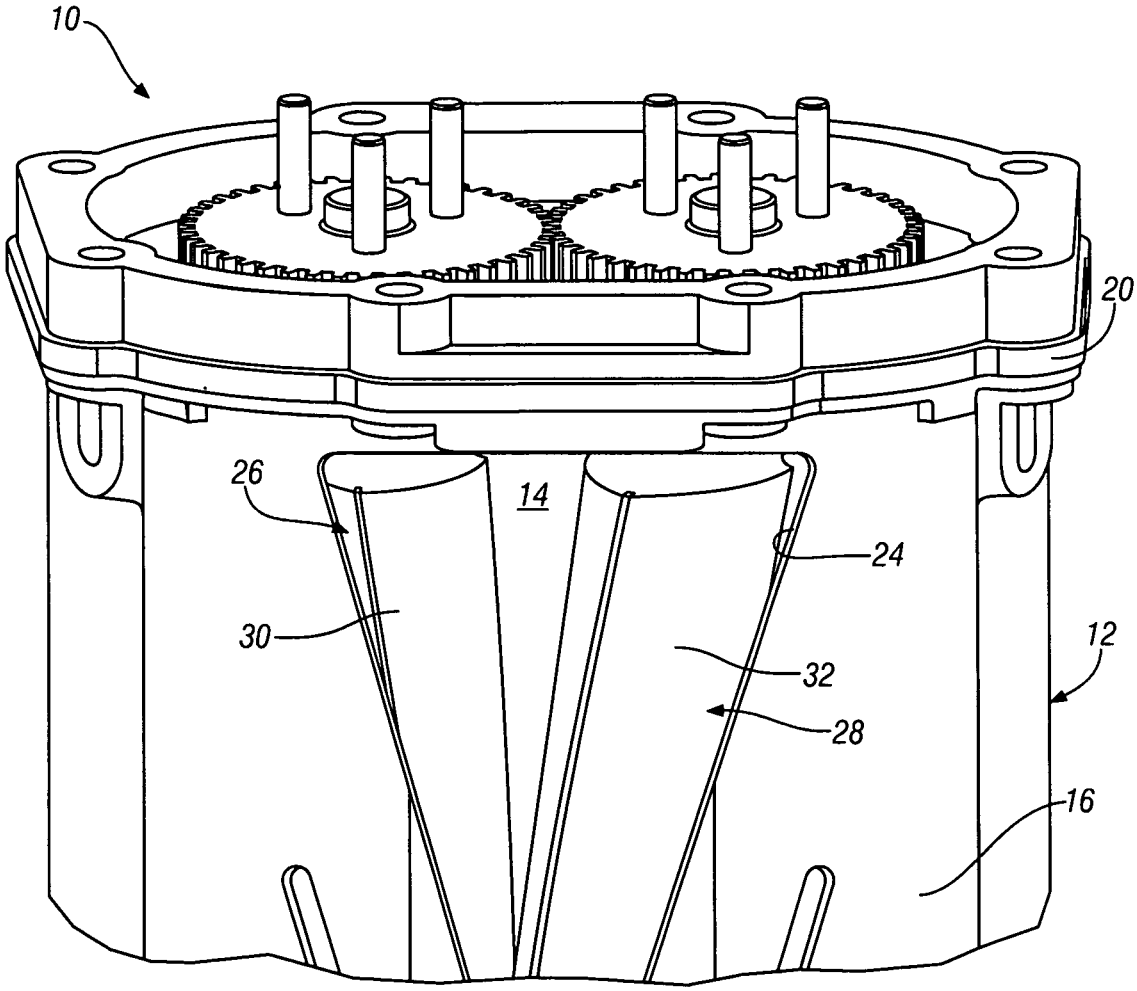
FIG. 2 is a partial top view of the supercharger of FIG. 1.

In accordance with an exemplary embodiment of the present invention FIGS. 1 and 2 illustrate a positive displacement, helical lobed supercharger 10 (Roots-type supercharger) according to the invention. Supercharger 10 includes a housing 12 having an internal cavity 14 defined by a surrounding wall 16 and upstream and downstream end walls 18, 20, respectively. An inlet opening 22 in a lower portion of the upstream end wall 18 fluidly communicates the internal cavity 14 with a source of inlet air from an air intake system (not shown). An outlet opening 24 extends through the surrounding wall 16, adjacent the downstream end wall 20 of the housing, and communicates the cavity 14 with a pressure charging air system of the engine intake system (not shown).

Figure 3:
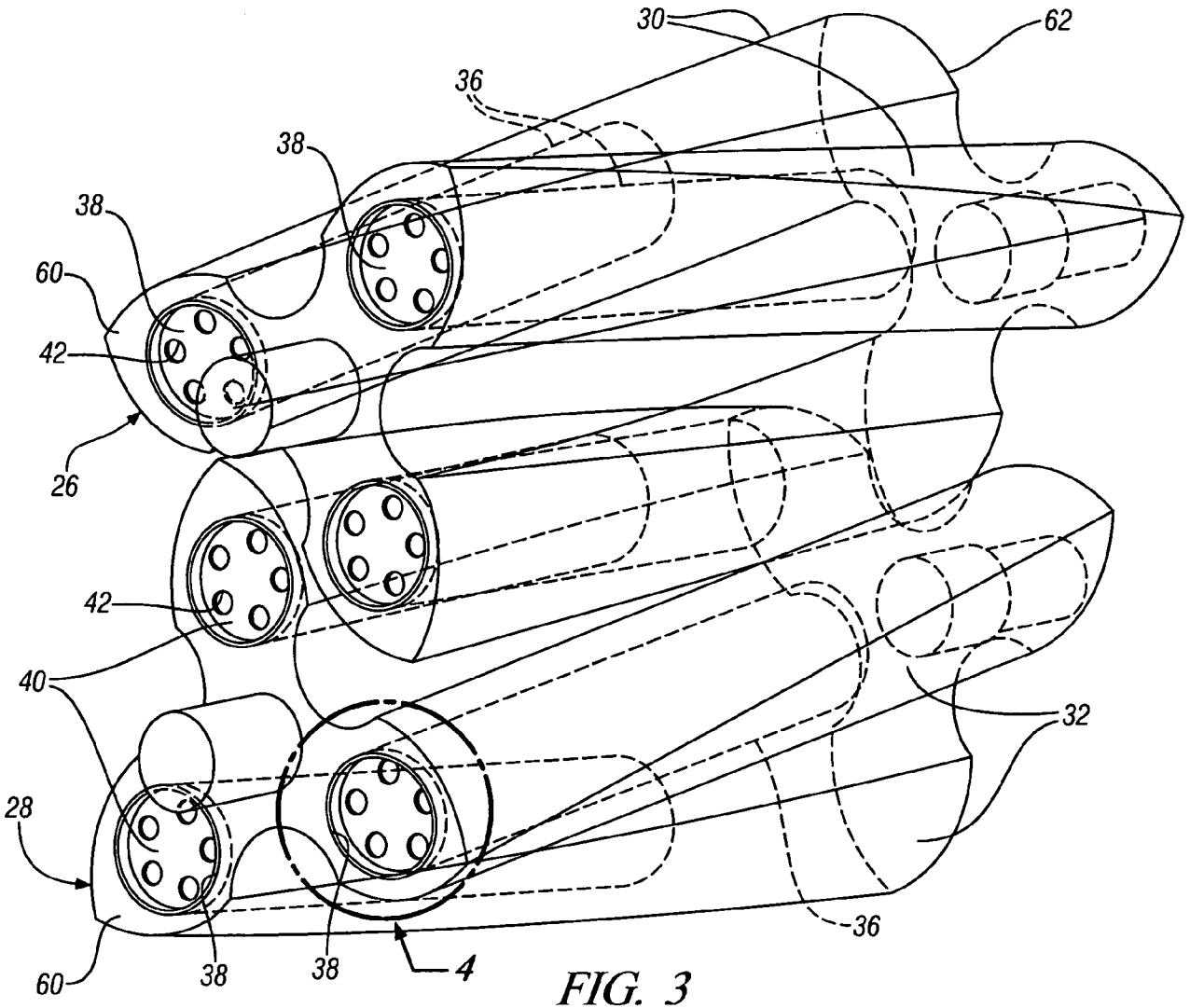
FIG. 3 is a partial, perspective view of two supercharger rotors of the supercharger of FIG. 1.

Within the internal cavity 14 there are rotatably mounted a pair of supercharger rotors 26, 28, each having a plurality of lobes 30, 32 with opposite helix angles, the details of which are shown in FIG. 3. The lobes 30, 32 of the rotors are interleaved in assembly of the supercharger 10, to define with the housing 12, helical rotor chambers (not shown). In the illustrated embodiment, the rotor lobes are twisted with equal and opposite helix angles. The direction of twist of lobes 30 from the inlet end face 60 to the outlet end face 62 is counter-clockwise, while the direction of twist, or helical change, of the lobes 32 is clockwise.

In order to reduce the rotating inertia of the plurality of lobes 30, 32, the lobes may be partially hollow, FIG. 3. The hollow lobes 30, 32 each define an inner chamber 36 which terminates in an upstream facing (i.e. towards inlet opening 22) lobe end opening 38. The hollow rotors 30, 32 maybe produced using methods such as drilling following forming, investment casting, helical pull die-casting or other suitable method of manufacturing and are typically constructed of a metal alloy, ceramic or other suitable material which is capable of exhibiting durability in a high temperature, high pressure environment. The air mass in the inner chambers 36 of the hollow rotors 30, 32 may be useful as a damping air mass, in the reduction of noise adjacent to the upstream end wall 18 of the supercharger 10.

In an exemplary embodiment of the invention, a plurality of perforated upstream end faces or plugs 40 have one or more necks or ports 42 formed therein. The end faces 40 are placed within, or adjacent to, the upstream facing lobe end openings 38 at the inlet ends of the lobes 30, 32 and are configured to partially close the upstream facing lobe end openings 38 of the hollow supercharger rotors 26, 28.

Figure 4:
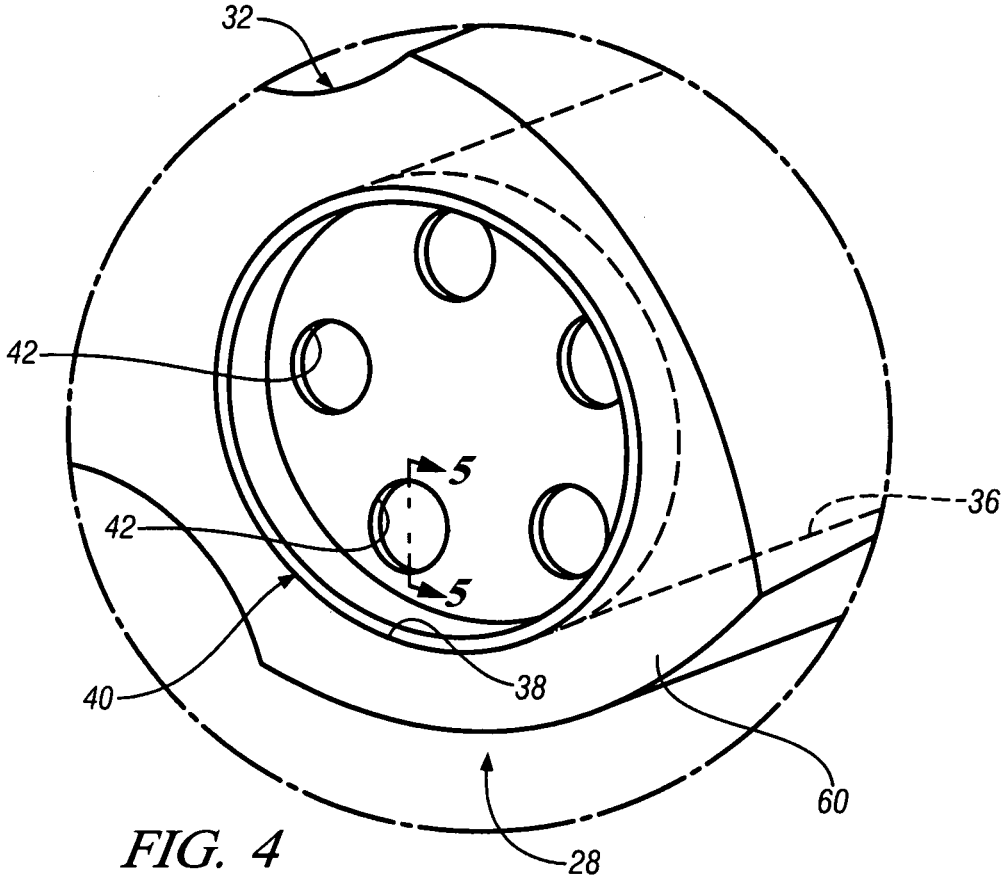
FIG. 4 is an enlarged view of a supercharger lobe of FIG. 3 taken at region 4 of FIG. 3.
Figure 5:
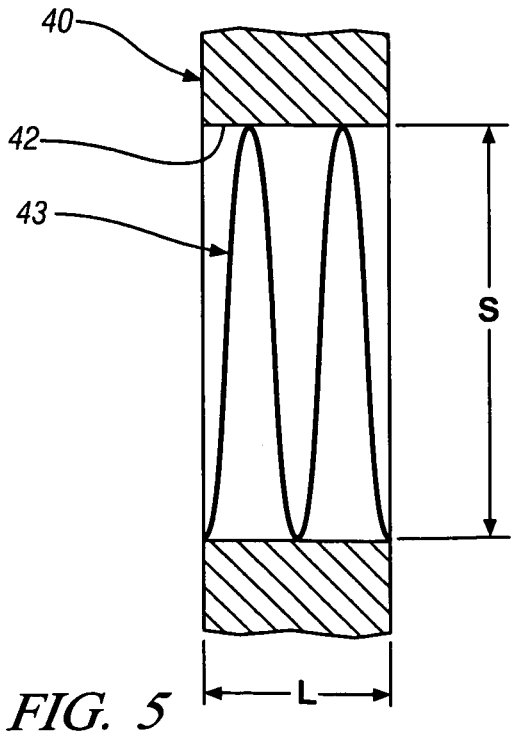
FIG. 5 is a sectional view through the supercharger lobe of FIG. 4 taken at section line 5-5 of FIG. 4.

As illustrated in FIGS. 4 and 5, in one embodiment, the necks or ports 42 have a length "L" and a diameter "S" defining a port cross-sectional area and a volume. The necks or ports 42 cooperate with a damping air mass in each inner chamber 36 of the hollow rotors 26, 28 to define a Helmholtz-type resonator. An air mass in each neck or port 42 oscillates, as illustrated by wave 43, and the adjacent and fluidly connected damping air mass, in the inner chamber 36, operates as a spring mass to effectively damp the oscillating wave 43, thereby attenuating the sound frequency caused by pressure pulsations adjacent to the upstream end wall 18 of the supercharger housing 12.

Figure 7:
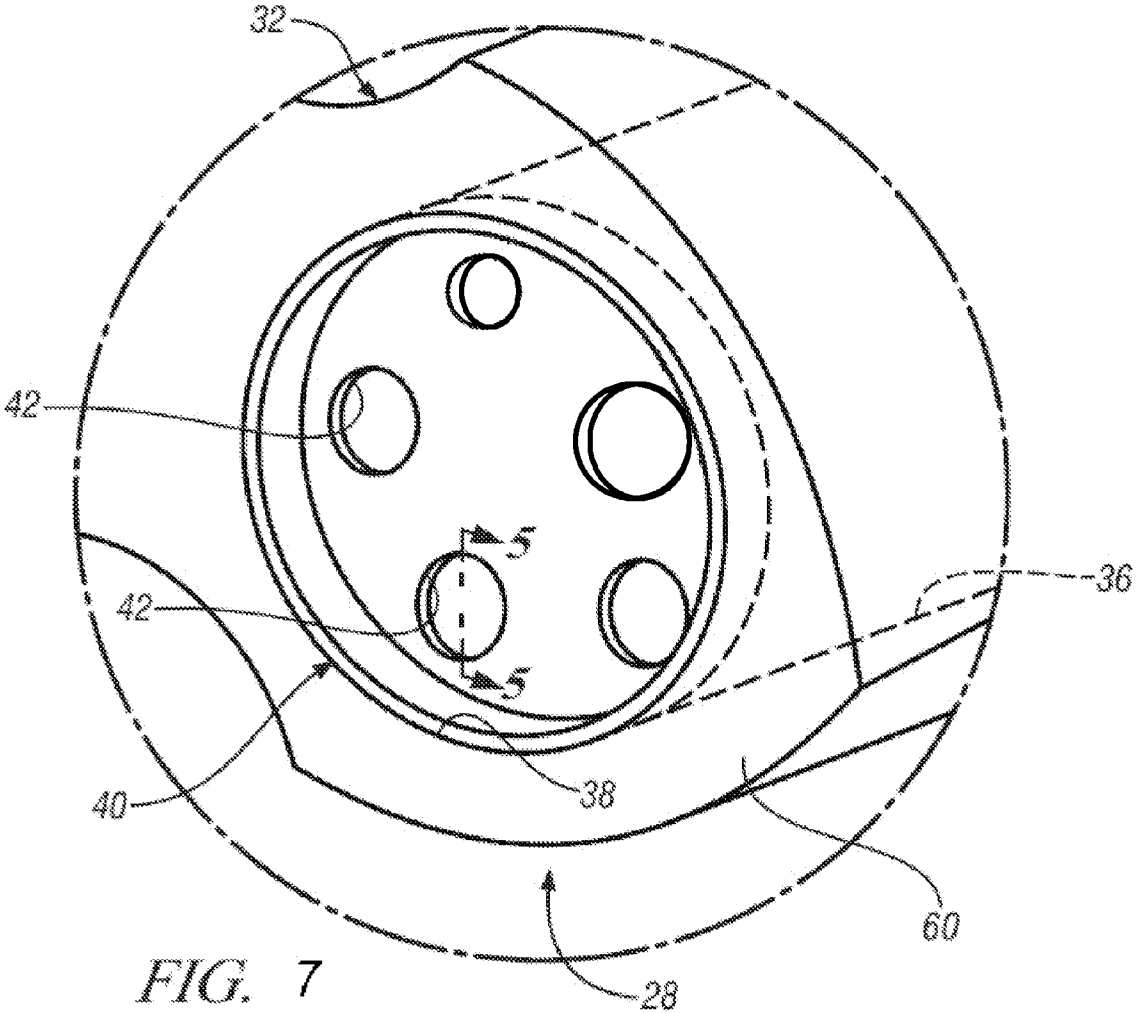
FIG. 7 is an enlarged view of another exemplary embodiment of a supercharger lobe of FIG. 3 taken at region 4 of FIG. 3.

The sound frequency that is attenuated by the resonator is determined by the combination of a number of variables such as the volume of the air mass of the inner chamber 36, which is a function of the size of the inner chamber, and by the number of ports 42 and the volume of the air mass in each port 42; as determined by the length "L" and/or the diameter "S" that define a port cross-sectional area and the volume of the ports 42. It is contemplated that a single perforated face or plug 40 may include a plurality of necks or ports 42 with different lengths and/or diameters such that the single perforated face or plug 40 may attenuate multiple frequencies, for example, as shown in FIG. 7. It is also contemplated that each neck or port of a single perforated end face may include a different length and/or diameter. As a result, the supercharger 10 may be tuned to address desired sound frequencies associated with the upstream end wall 16 and the inlet opening 22 of the supercharger 10. In an exemplary embodiment, and as illustrated in FIG. 1, the three-lobe configuration of the supercharger rotors 26, 28 and their interleaved relationship when installed in the supercharger housing 12, will typically assure that at least three perforated faces or plugs 40 are indexed with the supercharger inlet opening 22 during operation, thereby assuring continuous noise attenuation.

Figure 6:
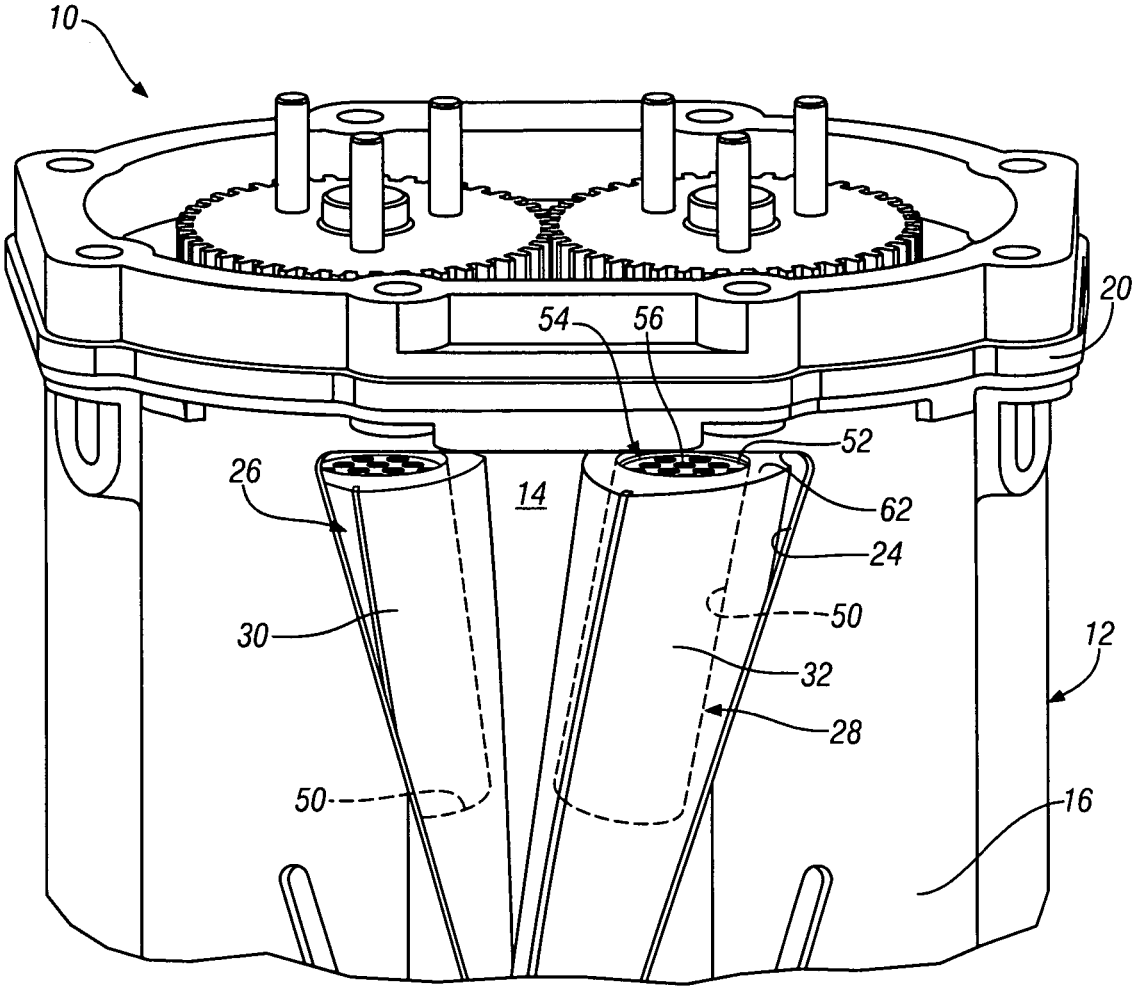
FIG. 6 is a partial top view of another embodiment of a Roots-type supercharger embodying features of the present invention.

In another, exemplary embodiment of the invention shown in FIG. 6 the plurality of hollow lobes 30, 32 each define an inner chamber 50 terminating in a downstream facing lobe end opening 52 (i.e. towards the downstream end wall 20 and outlet opening 24) associated with the outlet opening 24 of the supercharger housing 12. The air mass in each inner chamber 50 of the hollow rotors 26, 28 may be useful in the reduction of noise adjacent to the outlet end wall 20 of the supercharger 10. Perforated downstream end faces or plugs 54 have one or more necks or ports 56 formed therein. The downstream end faces or plugs 54 are placed adjacent to or within the downstream facing lobe end openings 52 and are configured to partially close the outlet openings 24. The necks or ports 56 have a length "L" and a diameter "S" (defining a port cross-sectional area and a volume) and cooperate with the associated air masses of the inner chambers 50 to define a resonator of the Helmholtz variety which operates in a similar manner to that described above for the perforated upstream end faces 40 and inner chambers 36 of the plurality of supercharger rotor lobes 30, 32. As a result, the supercharger may be tuned to address desired noise frequencies associated with the outlet opening 24 and downstream end wall 20 of the supercharger 10.

While the invention has been described with reference to exemplary embodiments, it will be understood by those skilled in the art that various changes may be made and equivalents maybe substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A supercharger comprising:

first and second supercharger rotors disposed for rotation in the supercharger and each having a plurality of lobes configured to move air from an inlet to an outlet of the supercharger;

an inner chamber defined in each of the plurality of lobes and configured to terminate at a lobe end opening;

a perforated end face partially closing each lobe end opening;

a plurality of ports extending through each perforated end face and supporting an oscillating air mass therein;

a damping air mass in each inner chamber, adjacent to and in fluid communication with the oscillating air mass within each port of the plurality of ports, the damping air mass damping the oscillating air mass, thereby attenuating sound generated by the supercharger at at least one predetermined frequency based on a shape and configuration of the plurality of ports, wherein a length and a diameter of each of the at least one port is configured to attenuate a desired sound frequency.

2. The supercharger of claim 1, wherein the perforated end faces partially closing each lobe end opening and the associated inner chambers defined in each of the plurality of lobes define Helmholtz resonators.

3. The supercharger of claim 1, wherein the plurality of ports include different lengths and/or diameters such that the each perforated end face partially closing each lobe end opening is configured to attenuate a plurality of sound frequencies.

4. The supercharger of claim 1, wherein the lobe end openings are associated with an inlet end of the supercharger.

5. The supercharger of claim 1, wherein the lobe end openings are associated with an outlet end of the supercharger.

6. The supercharger of claim 1, wherein the perforated end faces partially closing each lobe end opening comprise plugs fixed adjacent to or within the lobe end openings.

7. A supercharger comprising:

an axially extending housing having an upstream end wall, a downstream end wall and a surrounding wall extending therebetween to define an internal cavity within the axially extending housing;

an inlet opening in said housing configured to fluidly communicate the internal cavity with a source of inlet air;

an outlet opening in said housing configured to fluidly communicate the internal cavity with a compressed air chamber;

a plurality of supercharger rotors, each having a plurality of interleavable lobes, disposed for rotation within the internal cavity of the axially extending housing and configured to move air from the inlet opening to the outlet opening;

an inner chamber defined in each interleavable lobe and terminating at a lobe end opening;

a perforated end face partially closing each lobe end opening;

a plurality of ports extending through each perforated end face and supporting an oscillating air mass therein; and a damping air mass in each inner chamber, adjacent to and in fluid communication with the oscillating air mass within each port of the plurality of ports, the damping air mass damping the oscillating air mass, thereby attenuating sound generated by the supercharger at at least one predetermined frequency adjacent to the lobe end openings based on a shape and configuration of the plurality of ports, and the inlet opening is shaped such that at least three perforated end faces are indexed with the inlet, wherein a length and a diameter of each of the at least one port in the perforated end faces is configured to attenuate a desired sound frequency.

8. The supercharger of claim 7, wherein the perforated end faces and the inner chambers in the plurality of lobes define Helmholtz resonators wherein the damping air masses in the inner chambers operate as spring.

9. The supercharger of claim 7, wherein the plurality of ports include different lengths and/or diameters such that each perforated end face partially closing each lobe end opening is configured to attenuate a plurality of sound frequencies.

10. The supercharger of claim 7, wherein the lobe end openings are associated with the inlet opening of the supercharger.

11. The supercharger of claim 7, wherein the lobe end opening are associated with the outlet opening of the supercharger.

12. The supercharger of claim 7, wherein the perforated end faces comprise plugs fixed adjacent to or within the lobe end openings.

13. A method of sound attenuation in a supercharger having a plurality of rotatable supercharger rotors each having a plurality of interleavable lobes comprising;

forming an inner chamber in each interleavable lobe;

terminating each inner chamber at a lobe end opening of an interleavable lobe;

partially closing each lobe end opening with a perforated end face;

perforating each of the end faces with a plurality of ports having a length and a diameter, wherein the at least one port of each end face is shaped and configured to operate with an air mass in an inner chamber to attenuate sound generated by the supercharger at at least one predetermined frequency adjacent to the lobe end opening; and selecting a length and a diameter of the at least one port in each perforated end face to attenuate a desired sound frequency.

14. The supercharger of claim 1, wherein the inlet is positioned adjacent to an end of the rotor where the lobe end openings are positioned, and is shaped such that at least three perforated end faces are indexed with the inlet.

15. The supercharger of claim 1, wherein the plurality of ports are shaped and configured as circles.

* * * * *